United States Patent [19]

Thackrey

[11] Patent Number: 4,782,966

[45] Date of Patent: Nov. 8, 1988

[54] COMPLIANCE-ENHANCING PRESCRIPTION VIAL

[76] Inventor: James D. Thackrey, 13852 Dall Ln., Santa Ana, Calif. 92705

[21] Appl. No.: 105,397

[22] Filed: Oct. 7, 1987

[51] Int. Cl.[4] ..... B65D 83/04

[52] U.S. Cl. ..... 215/230; 206/459; 206/534; 116/308

[58] Field of Search ..... 206/459, 534; 215/218, 215/219, 220, 221, 230, 330; 116/308

[56] References Cited

U.S. PATENT DOCUMENTS

| | | | |
|---|---|---|---|
| 3,151,599 | 10/1964 | Livingston | 215/230 |
| 3,343,697 | 9/1967 | Roberts et al. | 215/220 |
| 3,749,824 | 8/1973 | Garby | 116/308 |
| 3,887,099 | 6/1975 | Gillman et al. | 215/220 |
| 3,926,326 | 12/1975 | Grau | 215/218 |
| 4,011,829 | 3/1977 | Wachsmann et al. | 206/534 |
| 4,489,834 | 12/1984 | Thackrey | 206/534 |
| 4,528,933 | 7/1985 | Allen | 206/534 |

*Primary Examiner*—David T. Fidei

*Attorney, Agent, or Firm*—James D. Thackrey

[57] ABSTRACT

A prescription vial which counts cyclically, through a window in the cap, how many times it has been opened/closed that day. The construction is unique in that the principal parts can be formed with straight strokes of the forming press, thus they are suitable for mass production. Spring fingers on an index plate extend past the sealing disc to ride on the upper flank of the closure threads. The fingers touch the thread at a flat helical angle. When the cap is rotated in one direction the index plate and fingers move with it; in the other direction the cap turns but the fingers will not pass an abutment on the thread, so force the index plate to turn inside the cap.

10 Claims, 2 Drawing Sheets

COMPLIANCE-ENHANCING PRESCRIPTION VIAL

BACKGROUND OF THE INVENTION

1. Field of the Invention

The invention is an improved construction of vials furnished to patients by pharmacies, filled with doses of medicine.

2. Description of Prior Art

The existing common construction of prescription vials includes no provision for assisting the patient in keeping track of whether or not he has taken a prescribed dose of medicine. It is so very easy to forget whether or not he has taken a particular dose (according to instructions printed on the label) that many times a patient may fail to take a given dose at all, or may take a double dose near the time designated on the label. This is a serious shortcoming particularly for people who take numerous pills, since the taking of them becomes an uneventful unmemorable routine. The problem is so prevalent that the medical profession has coined a term, "non-compliance," to describe failure of the patient to comply with the doctor's orders. These consequences to the patient's well being are obvious.

My invention, which is an improvement and refinement on my earlier U.S. Pat. No. 4,489,834, overcomes a substantial part of this non-compliance--the part due to confusion or uncertainty on the part of the patient. The vial automatically tells him whether or not it has been opened.

A problem with the vial on which patent 4,489,834 was issued concerns the producibility of certain parts. Prescription vials are made in vast quantities and sell for very low prices. Therefore, cost is crucial to their acceptance. In spite of the advantages occurring from improving compliance, the cost factor of two parts has prevented acceptance by industry of my earlier counting vial. Firstly, the added part, the indicator element, which indexes part of a turn with respect to the cap each time the bottle is opened, contained a skirt directly above its finger springs. The skirt also retained the seal disc. Secondly, the threads on the top of the vial also had portions in which one ridge was above another.

Both parts thus could not be produced by a simple one-directional motion of a press; they required extra transverse motions of the die to extract the injection molded part. The extra motions not only made the dies more expensive, for high production they increased the spacing between cavities, decreasing the yield per hit, as well as potentially introducing maintenance problems.

The present invention overcomes these complexities. Both problem parts can be made with a straight fore-and-aft stroke of the moveable part of the die. Moreover, one of the parts can now be made of stamped metal which potentially reduces production time and cost even more.

SUMMARY OF THE INVENTION

As stated above, this invention renders a counting prescription vial, of the type displaying index marks through a window in the cap and automatically advancing those marks each time the cap is removed and replaced, more practical. This is done by changing the design of certain parts and by redistributing the necessary functions among the parts.

The index-mark-bearing element, now called the index plate or the serial indicator plate, rests in the cap directly under the window. Its perimeter consists of a number of spring fingers surrounding the central portion on which the index marks (also called the serial indicators) are placed. The spring fingers extend circumferentially just short of the adjacent spring finger, and downward past the outer diameter of the disc-spring member which seals the container opening. The tip of one or more spring fingers rests on an inwardly-projecting tang in the cap, this tang being that which engages the container threads. The central portion of the index plate also contains means for pressing the disc-spring sealing member down against the container opening. It may also contain a ratchet strip to enforce rotation of the cap upon the index plate, and/or pillars or posts extending downward from the spring finger attachment points, shorter than the spring fingers to limit the deflection of the spring fingers to a safe amount.

The threads on the container do not overlap one another transversely, thus allowing easy extraction from the die. This is accomplished by providing more spring fingers than there are thread-starts, so it is not necessary to rotate the cap the full distance between thread-starts in order to bring the next spring around to the active thread-abutting position (the position in which, when the rotational direction is reversed, it will engage the appropriate thread abutment). Since the inwardly-facing tang on the cap can slide axially an unlimited distance through a thread-start with the new thread, thus overstressing the spring fingers, a stop to limit this motion may be incorporated in the thread if the pillars are not used for this purpose. Finally, the upper flank of the thread may be sloped downward for two purposes, to provide a positive stop when the inward-facing tab on the cap is at a thread-start, and to reduce the deflection required of the spring fingers.

BRIEF DESCRIPTION OF THE DRAWINGS

FIG. 1 is a developed view of the container threads for the version shown in FIG. 1.

FIG. 8 *a–d* shows the same developed views and interactions as FIG. 7 *a–d* except it is the preferred version of the invention, indexing when the cap is twisted on.

DETAILED DESCRIPTION OF THE INVENTION

Figure 1:
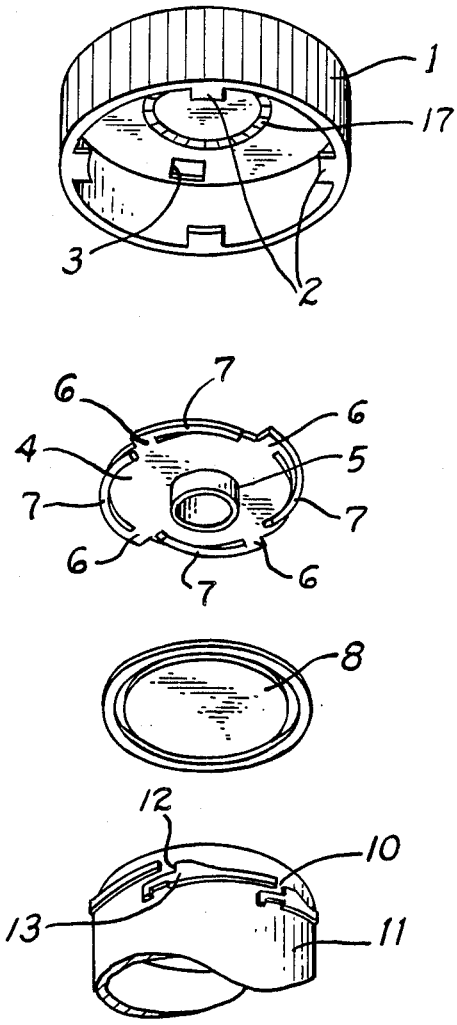
FIG. 1 is an exploded view of one verison of the invention, shown in perspective.

As shown in FIG. 1, there are four parts to the container-cap assembly; three of them being nested in the cap subassembly. The improvements which constitute the invention are concentrated on two parts, the index plate (4) and the container threads (13), but there are also changes in how the parts interact. Specifically, the cap (1) in the preferred embodiment need be rotated through a smaller angle, and in the preferred embodiment its tangs (2) are in full-width contact with the container threads. The disc spring member (8) is supported radially within the cap by contact with the spring fingers (7) on its outer diameter, and if pillars (22) are used, with the pillars. The skirt feature of the prior art is eliminated.

To expedite explanations, the terms "thread" and "flank" are used to describe raised ridges on the container and the axial faces thereof. Thus, as used here, it does not imply that a thread flank is helical.A tang traversing a thread (as used herein) can advance, regress, or remain constant in elevation.

Figure 5:
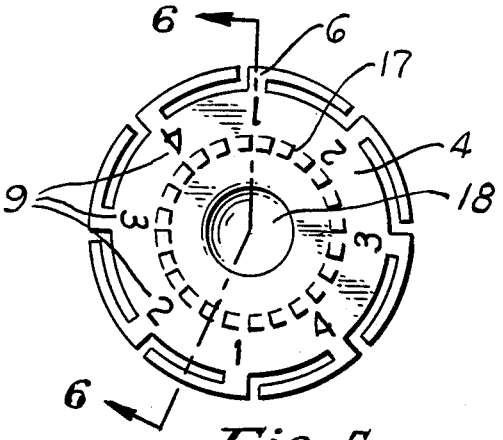
FIG. 5 is a top view of the preferred embodiment version of the index plate.
Figure 6:
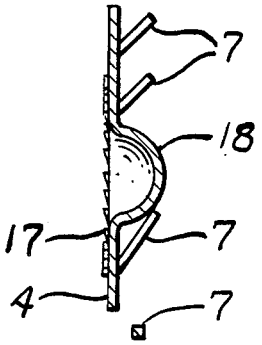
FIG. 6 is a section of FIG. 5.
Figure 7A:
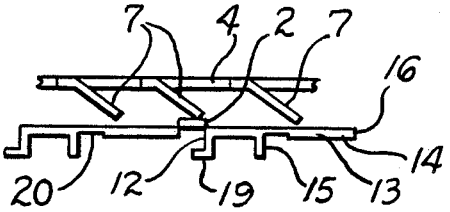
FIG. 7 *a–d* shows, in a developed view, the interaction between index plate and threads as the container is closed and opened. The indexing motion occurs when the cap is twisted off.
Figure 8A:
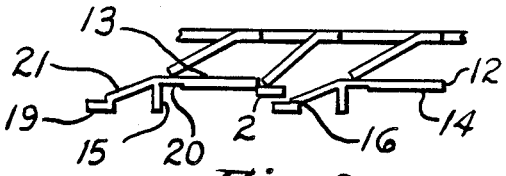
Figure 7B:
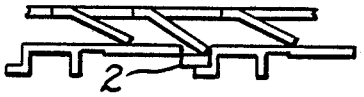
Figure 8B:
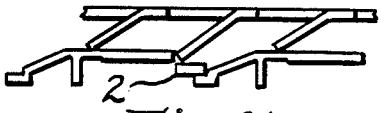
Figure 7C:
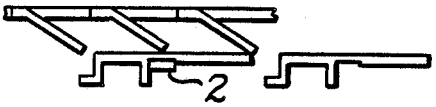
Figure 8C:
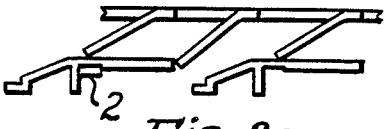
Figure 7D:
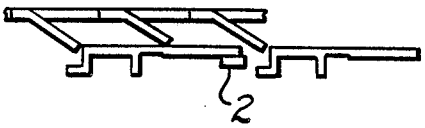
Figure 8D:
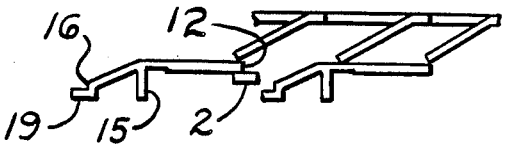

Item 1 is the cap which includes window (3) in its top surface, ratchet-strip (17) on the underneath surface, and as many inward-projecting tangs (2) as there are thread-starts (10). Index plate (4) bears numbers other marks (9) on its upper surface, shown only in FIG. 5, positioned to be visible through window (3). A protrusion shown as (5) in FIG. 1 and (18) in FIG. 6 extends downward from index plate (4) and, when the container is closed, forces disc spring member (8) against the rim of container (11) effecting a seal. Spring fingers (7) extend past the outer diameter of disc spring (8) and prevent its moving laterally enough to pass through the opening between inward-projecting tangs (2). Of the number of spring-fingers (7), some rest against the top surface of inward-projecting tangs (2) when the cap is removed and, driven by the ratchet strip (17), follow rotational motion of the tangs unless the spring finger is in contact with an abutment surface (12) on the thread. When that occurs further rotation of tang (2) and cap (1) creates relative rotational motion between index plate (4) and cap (1), causing the numbers or other marks (9) in the window (3) also called the serial indicators, to advance until the tang (2) reaches the rotational stop surface (15), at which time the next successive indicator (9) is displayed through the window (3). Thus each full removal-replacement cycle of the cap includes one part in which indexing of the serial indicator (9) occurs.

The manner of functioning described above is common to all versions of the invention. Also common to all versions is the feature that spring fingers (7) or index plate (4) do not extend circumferentially beyond the adjacent spring mount (6). That is spring fingers (7) terminate short of the mounting for the adjacent spring finger. Thus, whether the index plate is fabricated by injection molding (such as the design shown in FIGS. 1, 3, 9, and 10) or by metal stamping (such as the design shown in FIGS. 5 and 6) only a straight closure motion is required of the forming die.

The container thread (13) is shown in three embodiments. It always has an abutment surface (12), stop (15), and a flank (14) against which the top surface of inward-projecting tang (2) slides. It always has a portion (16) which is circumferentially spaced such a distance from abutment surface (12) as to create a thread-start for entry of inward-projecting tang (2). The number of different index marks, the number of thread starts and the number of inward-projecting tangs are the same for any given design vial in the preferred embodiment. In all the Figures this number is four.

The preferred embodiment of container thread (13) is shown in FIG. 8. In addition to the features described above, Figure 8 shows lug (19) positioned below each thread-start at an elevation such that tang (2), when resting on lug (19) will have its upper surface slightly below flank (14). With the downward motion of cap (1) stopped by lug (19) and the consequent indication to the user that rotation is the only option open to him, the spring fingers (7) of index plate (4) will not be subject to undue deflection and stress. Note that the lug does not impair the main purpose of the thread in FIGS. 7 and 8, the avoidance of overlap of adjacent threads.

Another feature shown in FIG. 8 (as well as FIG. 1 and 7) is childproofing notch (20). In the preferred embodiment childproofing notch (20) is located at stop (15), is wide enough to receive inward-projecting tang (2), and its depth with respect to flank (14) is a fraction of the thickness of tang (2). The childproofing notch serves to require simultaneous pressing and rotation in order to start the cap-removal process. The third feature of the preferred embodiment thread (FIG. 8) is extension portion (21) in which the upper flank of thread (13) slopes downward to lower portion (16) below the elevation of abutment surface (12) on the adjacent thread. The advantage occurring from sloping item (21) is twofold, the clockwise rotation of the cap by the user encounters a positive stop when tang (2) bottoms solidly on the lower part of abutment surface (12) on the adjacent thread, clearly indicating where the thread-start is, and the overall height of abutment surface (12) needed to engage the tip of spring finger (7) positively need not contribute fully to deflection of spring fingers (7). In the preferred embodiment, the lower surface of tang (2) may be substantially below flank (14) on the thread when the side of tang (2) strikes abutment surface (12).

The latter-described feature is possible to incorporate to a degree in the alternate thread design shown in FIG. 7. This alternate thread design is still right-hand, but the indexing takes place when the cap is removed. Indexing occurs when the cap is replaced in the preferred embodiment.

Figure 2:
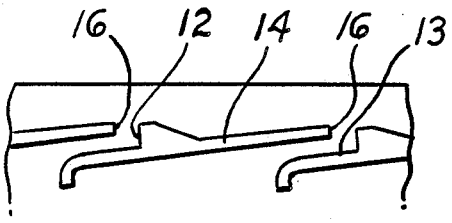
Figure 3:
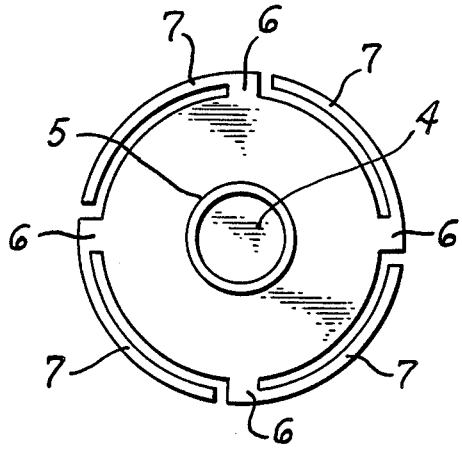
FIG. 3 is a bottom view of the index plate as shown in FIG. 1.
Figure 4:
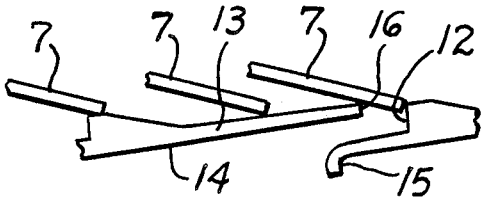
FIG. 4 shows the interaction between spring fingers and threads for the version of FIG. 1.

Both the threads shown in FIGS. 7 and 8 have the advantage that they do not require any secondary motion of the die for their formation, and removal of the finished part is by direct ejection. Dies with few moving parts are cheaper and more reliable for high production work. This advantage is lessened by the third container thread design shown in FIGS. 1, 2, and 4. Thread flank (14) is helical in this alternate embodiment. The need for lug (19) is eliminated by the upper flank of the adjacent thread, which serves the same purpose. Further description of this embodiment is not necessary as items 12, 13, 14, 15 and 16 have been functionally described above.

In all thread designs the rotational angle between tang stops which must be provided is the angle between spring-tips (i.e., the required motion of the index plate in order to bring the next spring tip to the point where it will contact a thread abutment) plus the angle between sides of the tang (since rotation is stopped by different sides) plus any slippage or engagement clearance of the ratchet strip, plus the amount the spring finger is shortened when it buckles against the cap internal diameter when it is driving the index plate. Provision for excess angle is harmless. One spring finger will drive the index plate; but since more are better, it is preferred to have spring fingers resting on all the inward-projecting tangs when the cap is separate from the container. Function requires only one, however, so it is possible to put only one more spring finger on the index plate than there are thread starts and tangs, and to so dimension and tolerance the various parts that all the plus factors mentioned above add up to less than the angle between adjacent spring fingers.

Figure 10:
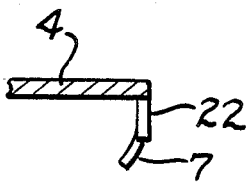
FIG. 10 is a section taken at 90° to FIG. 9.
Figure 9:
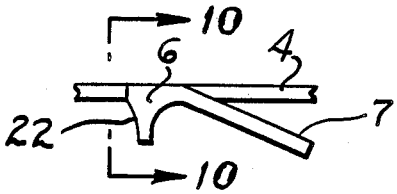
FIG. 9 is a side view showing the pillar element. It applies to the injection molded version of the index plate.

FIGS. 9 and 10 show the construction of the pillar (22). Pillars may be located on any spring finger mount (6). They pass outside disc-spring member (8), and limit the allowed deflection of spring fingers 7 by contacting the upper flank of thread (13).

Since the length available for the spring finger depends on their number and on the size of container, and since the deflection required of each spring finger depends on the molding practicality of the threads, there is not necessarily any one embodiment that represents the best choice for a particular vial. It is noted that stress in a given finger spring increases with increased deflection, and that particularly for finger springs molded of plastic, creep may occur if stress is sufficiently high, changing the at-rest position of the spring tip. Thus, the sheetmetal index plate is the preferred embodiment and may be required for some vials. Its disadvantage is that the metal-stampled index plate will be relatively thin and may not guide the disc-spring smoothly. Dealing with such considerations and tradeoffs do not require the inventive faculty.

The invention having been described in its several embodiments, it is clear that modifications are within the ability of those skilled in the art without exercise of the inventive faculty. Accordingly, the scope of the invention is defined in the scope of the following claims.

I claim:

1. A container for medicinal doses, the cap of which contains a window through which a serial indicator is visible, the serial indicator advancing each time the container is opened and closed by having spring fingers abut on portions of the attachment threads and so prevent rotation of the cap from driving the member which carries the serial indicator, the open end of the container and cap being generally cylindrical and being attached to each other by multiple start threads on the container which are engaged by inward-projecting tangs on the cap, and having a spring-disc member inside the cap, held down by the cap and sealing to the rim of the container opening, in which the improvement comprises:

an index plate having the serial indicators on the top surface of its central portion and having a number of spring fingers mounted so as to extend around the periphery of the central portion yet spaced therefrom, each said spring finger being of such length as to terminate short of the mounting portion of the adjacent spring finger, and also projecting below the bottom surface of said index plate, said index plate being located in the cap above the disc spring member with the spring fingers projecting below and past the outer diameter of the disc spring member, and multiple start threads on the container, the space between them forming a thread-start one side of which also comprises an abutment for the tip of a spring finger as said index plate rotates relative to the container, said multiple start threads having a lower flank terminating in a rotational stop surface against which the inward-projecting tang of the cap stops, and an extension portion on the upper flank of the thread which extends the upper flank clockwise from above the rotational stop surface to the side of the adjacent thread-start looking down, said extension portion having an upper flank which slopes away from the container rim in a clockwise direction when viewed from above whereby the finding of a thread-start by the user is facilitated.

2. A medicine container as in claim 1, further comprising:

mating ratchet strips on the underside of the cap and the upper surface of said index plate the engagement of which ratchet strips enhance friction between the cap and index plate.

3. A container as in claim 1 in which said index plate further comprises:

a multiplicity of pillars extending downward from the lower surface of the spring mounts and past the disc-spring member, said pillars being of such a length as to limit, by abutting on the container threads, the allowable deflection of said spring fingers.

4. A medicine container as in claim 1 further comprising at least two lugs projecting from the container wall below a thread-start at such an elevation that the upper surface of the inward-facing tangs of the cap, when resting on said lugs, will be below the clockwise lower flank of the adjacent thread whereby downward motion of the cap is limited by said lug to prevent deflection of the spring fingers beyond that required to allow the tang to engage the lower flank of the adjacent thread.

5. A medicine container as in claim 1, further comprising:

a number of spring fingers twice the number of thread starts, with the series of different serial indicators repeated twice, so as to have a serial indicator associated with each spring finger.

6. A container for medicinal doses, the cap of which contains a window through which a serial indicator is visible, the serial indicator advancing each time the container is opened and closed, by having spring fingers abut on portions of the attachment threads and so prevent rotation of the cap from during the member which carries the serial indicators, the open end of the container and cap being generally cylindrical and being attached to each other by multiple start threads on the container which are engaged by inward-projecting tangs on the cap, and having a spring-disc member inside the cap, held down by the cap and sealing to the rim of the container opening, in which the improvement comprises:

a substantially flat index plate having the serial indicators on the top surface of its central portion and having a number of spring fingers mounted with one end coplanar with the central portion so as to extend around the periphery of the central portion yet spaced therefrom, each said spring finger being of such length as to terminate short of the mounting portion of the adjacent spring finger, and also projecting below the bottom surface of said index plate, said index plate being located in the cap above the disc spring member with the spring fingers projecting below and past the outer diameter of the disc spring member.

7. A container as in claim 6, in which said index plate is of sheetmetal and the number of spring fingers is equal to the number of different serial indicators yet greater than the number of thread starts.

8. A container as in claim 6 in which said index plate is of plastic and the number of spring fingers is equal to the number of different serial indicators yet greater than the number of thread starts.

9. A container for medicinal doses, the cap of which contains a window through which a serial indicator is visible, the serial indicator advancing each time the container is opened and closed, by having spring fingers abut on portions of the attachment threads and so prevent rotation of the cap from driving the member which carries the serial indicators, the open end of the container and cap being generally cylindrical and being attached to each other by multiple start threads on the container which are engaged by inward-projecting tangs on the cap, and having a spring-disc member inside the cap, held down by the cap and sealing to the rim of the container opening, in which the improvement comprises:

multiple start threads on the container, the space between them forming a thread-start one side of which also comprises an abutment for the tip of a spring finger as said index plate rotates relative to the container, said multiple start threads having a lower flank terminating in a rotational stop surface against which the inward-projecting tang of the cap stops, and an extension portion of the upper flank of the thread which extends the upper flank clockwise from above the rotational stop surface to the side of the adjacent thread-start looking down, the circumferential rotation of the inward-projecting tang between the thread start and the end of the rotational stop surface being greater than the circumferential spacing of adjacent spring fingers, whereby each full removal-replacement cycle of the cap will include one part in which the cap rotates with respect to said index plate because the index plate is restrained by one or more spring-fingers being against the abutment, the relative rotation advancing the serial indicator.

10. A container as in claim 9, in which the side of the thread-start which comprises an abutment is the counter-clockwise side looking down.

* * * * *